US011408195B2

(12) United States Patent
Hudrlik et al.

(10) Patent No.: US 11,408,195 B2
(45) Date of Patent: Aug. 9, 2022

(54) CANOPY FRAME INCLUDING TENSION MEMBER SYSTEM

(71) Applicant: CARAVAN CANOPY INT'L, INC., La Mirada, CA (US)

(72) Inventors: David Charles Hudrlik, Brea, CA (US); Jason Scott Hudrlik, Lakewood, CA (US)

(73) Assignee: Caravan Canopy Int'l, Inc., Cerritos, CA (US)

( * ) Notice: Subject to any disclaimer, the term of this patent is extended or adjusted under 35 U.S.C. 154(b) by 0 days.

(21) Appl. No.: 17/125,731

(22) Filed: Dec. 17, 2020

(65) Prior Publication Data

US 2021/0189758 A1 Jun. 24, 2021

Related U.S. Application Data

(60) Provisional application No. 62/949,977, filed on Dec. 18, 2019.

(51) Int. Cl.
*E04H 15/50* (2006.01)
*E04H 15/32* (2006.01)

(52) U.S. Cl.
CPC ..... *E04H 15/50* (2013.01); *E04H 15/32* (2013.01)

(58) Field of Classification Search
CPC ..... E04H 15/50
See application file for complete search history.

(56) References Cited

U.S. PATENT DOCUMENTS 5,274,980 A * 1/1994 Zeigler ..... E04H 15/50 135/123
5,862,826 A * 1/1999 Gremont ..... E04H 15/58 135/124
6,112,756 A 9/2000 Tseng
6,138,702 A * 10/2000 Carter ..... E04H 15/50 135/145

(Continued)

FOREIGN PATENT DOCUMENTS

CN 101988349 A 3/2011

OTHER PUBLICATIONS

Canada Office Action in corresponding Canada Application No. 3,103,395, Canada Office Action dated Mar. 7, 2022 (4 pgs.).

(Continued)

*Primary Examiner* — David R Dunn
*Assistant Examiner* — Danielle Jackson
(74) *Attorney, Agent, or Firm* — Lewis Roca Rothgerber Christie LLP

(57) ABSTRACT

A collapsible canopy frame includes a plurality of side poles, a plurality of edge scissor assemblies coupling adjacent side poles from among the plurality of side poles to each other, a center pole to support a canopy covering, a plurality of center pole ribs each coupling the center pole to a respective side pole of the adjacent side poles; a plurality of support members coupling the plurality of center pole ribs to the adjacent side poles, the plurality of support members being coupled to the plurality of center pole ribs through respective joints that are movable along respective center pole ribs from among the plurality of center pole ribs, and one or more tension members coupled to the plurality of center pole ribs.

16 Claims, 15 Drawing Sheets

(56) References Cited

U.S. PATENT DOCUMENTS

| | | | | |
|---|---|---|---|---|
| 6,868,858 | B2 * | 3/2005 | Suh | E04H 15/48 135/145 |
| 6,874,519 | B2 * | 4/2005 | Chiang | E04H 15/50 135/131 |
| 6,929,017 | B2 * | 8/2005 | Byun | E04H 15/50 135/131 |
| 7,168,439 | B2 * | 1/2007 | Patel | E04H 15/50 135/131 |
| 7,178,539 | B2 * | 2/2007 | Patel | E04H 15/50 135/131 |
| 7,770,591 | B2 | 8/2010 | Tseng | |
| 8,220,477 | B2 * | 7/2012 | Park | E04H 15/50 135/145 |
| 9,234,366 | B2 * | 1/2016 | Mallookis | E04H 15/44 |
| 2004/0079406 | A1 | 4/2004 | Byun | |
| 2006/0191564 | A1 * | 8/2006 | Connelly | E04H 15/44 135/121 |
| 2011/0061702 | A1 * | 3/2011 | Lin | E04H 15/50 135/145 |
| 2014/0166798 | A1 * | 6/2014 | Davison | E04H 15/322 242/147 R |

OTHER PUBLICATIONS

Chinese First Office action dated Apr. 13, 2022 issued in corresponding CN Application No. 202011511102.1, 8 pages, with translation, 12 pages.

* cited by examiner

CANOPY FRAME INCLUDING TENSION MEMBER SYSTEM

CROSS-REFERENCE TO RELATED APPLICATION

This application claims the benefit of U.S. Provisional Application No. 62/949,977, filed on Dec. 18, 2019, entitled "CANOPY FRAME INCLUDING TENSION MEMBER SYSTEM," the entire content of which is incorporated by reference herein.

BACKGROUND

1. Field

Aspects of embodiments of the present invention relate to a collapsible canopy frame and, more particularly, to a collapsible canopy frame including a tension member system configured to support a canopy covering.

2. Description of Related Art

Typical collapsible canopy frames often include a plurality of telescoping legs, each having one or more X-shaped connectors to form scissor assemblies extending between the telescoping legs along the perimeter of the frame. The X-shaped scissor assemblies are movable relative to the telescoping legs to adjust the collapsible canopy frame between an expanded position and a collapsed position. In the expanded position, the collapsible canopy frame provides a temporary shelter. In the collapsed position, the collapsible canopy frame can be more readily transported. A variation of the typical scissor assembly canopy frame includes additional center scissor assemblies coupled between edge scissor assemblies and a center post. The center scissor assemblies are made using X-shaped connectors in a manner similar to how the edge scissor assemblies are constructed.

In a typical collapsible canopy, a canopy covering such as a cloth or leather covering is disposed above, and supported by, the collapsible canopy frame. Many typical frames also have a central support member that supports the canopy covering, creating a triangular or pyramidal shape. For example, in the typical scissor assembly canopy frame described above, the frame may include a central support member. At the same time as the scissor assemblies are expanded, the central support member is raised into a vertical supporting position and has an extendable vertical pole member that is used to support a canopy and provide a peak for the canopy. However, sagging of the canopy covering is typical of canopy frames with only a single central support member. Therefore, there is a need for a roof structure that fully supports a canopy covering and keeps it tautly stretched over the canopy frame.

Alternative collapsible canopy frames employ a cathedral-style roof structure having a plurality of ribs, each coupled to a telescoping leg on one end and to a central support member on the other end. Each rib may consist of a single rib member or a scissor assembly. In some canopy frames, the ribs are reinforced by support members coupled between each rib and a corresponding telescoping leg. However, many canopy frames employing a cathedral-style roof structure are relatively unstable and flimsy, which means that these structures tend to collapse in strong winds or otherwise must have lowered profiles.

Disfavored weather conditions including rain, snow or strong winds can result in buildup of physical debris on the canopy covering. Over time, the built up debris may cause the canopy cover to sag, rip or collapse, and/or the canopy frame to collapse or break.

Accordingly, a need exists for a collapsible canopy frame that maintains a tautly stretched canopy covering and supports the canopy covering against the elements.

SUMMARY

One or more embodiments of the present invention are directed to a collapsible canopy frame and tension member system.

In one embodiment of the present invention a collapsible canopy frame is provided that includes a plurality of side poles, a plurality of edge scissor assemblies coupling adjacent side poles from among the plurality of side poles to each other, a center pole to support a canopy covering, a plurality of center pole ribs each coupling the center pole to a respective side pole of the adjacent side poles, a plurality of support members coupling the plurality of center pole ribs to the adjacent side poles, the plurality of support members being coupled to the plurality of center pole ribs through respective joints that are movable along respective center pole ribs from among the plurality of center pole ribs, and one or more tension members coupled to the plurality of center pole ribs.

In one embodiment, each of the one or more tension members is a single continuous band.

In one embodiment, each of the plurality of center pole ribs has a through hole to receive a tension member.

In one embodiment, the one or more tension members are detachably coupled to the plurality of center pole ribs.

In one embodiment, the collapsible canopy frame further includes a tensioner coupled to opposite ends of a tension member from among the one or more tension members, the tensioner being configured to adjust an amount of tension applied to the tension member.

In one embodiment, the collapsible canopy frame further includes a plurality of center scissor assemblies coupling the center pole to the plurality of edge scissor assemblies.

In one embodiment, the one or more tension members comprise a plurality of tension members substantially parallel and spaced from each other.

In one embodiment, the respective joints are between a pair of the plurality of tension members in accordance with the collapsible canopy frame being in an expanded state.

In one embodiment, the plurality of tension members are different in length from each other.

In one embodiment, a distance between adjacent tension members from among the plurality of tension members decreases along a direction from an upper portion of the plurality of center pole ribs to a lower portion of the plurality of center pole ribs.

In one embodiment of the present invention a collapsible canopy frame is provided that includes a center pole to support a canopy covering, a first center pole rib coupling the center pole to a first side pole, a second center pole rib coupling the center pole to a second side pole, a first edge scissor assembly coupling the first side pole to the second side pole, and a tension member coupled to the first center pole rib and the second center pole rib.

In one embodiment, the tension member is a single continuous band.

In one embodiment, the first center pole rib has a through hole to receive a tension member.

In one embodiment, the first center pole rib is detachably coupled to the first center pole rib.

In one embodiment, the collapsible canopy frame further includes a tensioner coupled to opposite ends of the tension member, the tensioner being configured to adjust an amount of tension applied to the tension member.

In one embodiment, the collapsible canopy frame further includes a first center scissor assembly coupling the center pole to the first edge scissor assembly.

In one embodiment, the collapsible canopy frame further includes an other tension member closer to the center pole than the tension member is to the center pole.

In one embodiment, the collapsible canopy frame further includes a support member coupling the first center pole rib to the first side pole, the support member being coupled to the first center pole rib through a joint that is movable along the first center pole rib. The joint is between the tension member and the other tension member in accordance with the collapsible canopy frame being in an expanded state.

In one embodiment, the tension member and the other tension member are different in length from each other.

In one embodiment, the tension member is closer to the other tension member than the other tension member is to the center pole.

This summary is provided to introduce a selection of features and concepts of example embodiments of the present invention that are further described below in the detailed description. This summary is not intended to identify key or essential features of the claimed subject matter nor is it intended to be used in limiting the scope of the claimed subject matter. One or more of the described features according to one or more example embodiments may be combined with one or more other described features according to one or more example embodiments to provide a workable method or device.

BRIEF DESCRIPTION OF THE DRAWINGS

These and other features and advantages of embodiments of the present invention will become more apparent by reference to the following detailed description when considered in conjunction with the following drawings. In the drawings, like reference numerals are used throughout the figures to reference like features and components. The figures are not necessarily drawn to scale.

DETAILED DESCRIPTION

Figure 1:
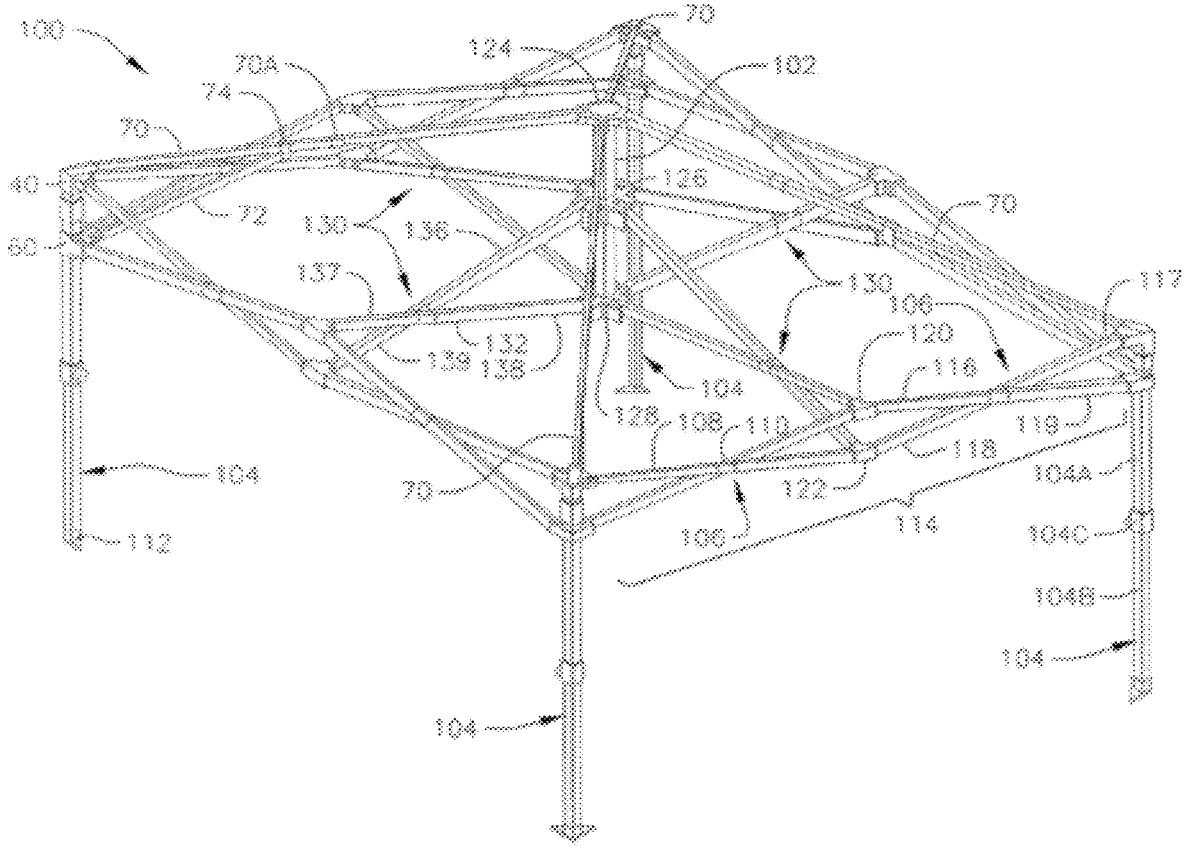
FIG. 1 Related Art
FIG. 1 is a perspective view of a canopy frame according to the related art.

In the following detailed description, certain embodiments of the present invention are shown and described, by way of illustration. As those skilled in the art would recognize, the described embodiments may be modified in various ways without departing from the spirit and scope of the present invention. Accordingly, the drawing and description are to be regarded as illustrative in nature, rather than restrictive.

As shown in FIGS. 1-8, a collapsible canopy frame according to embodiments of the present invention have a roof and support structure including a cathedral-style roof structure and a plurality of intercoupled edge and center scissor assemblies as described in U.S. Pat. No. 8,220,477, which is incorporated herein by reference in its entirety.

With reference to FIG. 1, a collapsible canopy frame 100 according to some embodiments of the present invention includes a center pole 102, telescoping side poles 104 and edge scissor assemblies 106 that intercouple each pair of adjacent side poles 104. Each of the edge scissor assemblies 106 is formed of a pair of scissor members 108 coupled together and rotatable about a pivot 110. In some embodiments, the canopy frame 100 further includes a plurality of center scissor assemblies 130 and a plurality of center pole ribs 70. Each of the center scissor assemblies 130 is formed of a pair of scissor members 132 pivotably coupled together at a hinged joint.

In some embodiments, each telescoping side pole 104 has a substantially square cross-section and a foot bracket 112 attached at a bottom end of the side pole 104 for supporting the weight of the collapsible canopy frame 100. Canopy frames according to other embodiments of the present invention may include greater or fewer than four side poles.

In some embodiments, the side poles 104 of each pair of adjacent side poles 104 are intercoupled to each other through a set 114 of two edge scissor assemblies 106. In other embodiments, the set 114 may include more than two intercoupled edge scissor assemblies 106. The edge scissor assemblies 106 of set 114 are pivotably coupled to respective side poles 104 and to each other. Upper and lower inner ends 116, 118 of each edge scissor assembly 106 are pivotably coupled to respective upper and lower inner ends 116, 118 of another edge scissor assembly 106 of the same set 114 via upper and lower coupling brackets 120 and 122.

Center pole 102 is configured to support a canopy covering at the center of the canopy frame 100. In some embodiments, near the top of the center pole 102 is a first hub 124, which couples a plurality of center pole ribs 70 to the center pole 102. The center pole 102 also has mounted thereon a second hub 126 and a third hub 128. The second hub 126 couples upper inner ends 136 of center scissor assemblies 130 to the center pole 102 and the third hub 128 couples lower inner ends 138 of the center scissor assemblies 130 to the center pole 102. In some embodiments, the second hub 126 is positioned on the center pole 102 between the first hub 124 and the third hub 128. In some embodiments, the second hub 126 is movable with respect to the center pole 102 while the third hub 128 is substantially stationary with respect to the center pole 102.

In some embodiments, each telescoping side pole 104 includes two telescoping sections 104A and 1046, which correspond to upper and lower sections, respectively. The upper and lower sections 104A and 1046 are coupled to each other through a height adjustment bracket 104C, which adjusts the relative positions of the upper and lower sections 104A and 1046 and therefore the height of each telescoping side pole 104. In other embodiments, the side poles may not be telescoping, and instead may have a fixed length.

In some embodiments, each telescoping side pole 104 has a first bracket 40 and a second bracket 60 mounted thereon. Each of the first brackets 40 couples one of the center pole ribs 70 to a corresponding one of the side poles 104. In some embodiments, the first bracket 40 is positioned above the second bracket 60 near the top of the side pole 104 and is stationary while the second bracket 60 is movable with respect to the side pole 104. Alternatively, the first bracket 40 may be positioned below the second bracket 60 on the side pole 104. At each corner of the canopy frame 100, upper outer ends 117 of the edge scissor assemblies 106 are pivotably coupled to one of the side poles 104 via the first bracket 40. Lower outer ends 119 of the edge scissor assemblies 106 are pivotably coupled to a corresponding side pole 104 via second bracket 60.

In some embodiments, the canopy frame 100 further includes the center scissor assemblies 130. Each center scissor assembly 130 can be formed by pivotably coupling a pair of scissor members 132 about their respective centers. In other embodiments, the pair of scissor members may be coupled together at a point other than their respective centers. In some embodiments, center scissor assembly 130 has substantially the same structure as edge scissor assembly 106. Each of center scissor assemblies 130 is pivotably coupled between the center pole 102 and a corresponding set 114 of edge scissor assemblies 106. In some embodiments, two or more center scissor assemblies 130 may be inter-coupled between the center pole 102 and a corresponding set 114 of edge scissor assemblies 106.

In more detail, each center scissor assembly 130 is pivotably coupled between the upper and lower coupling brackets 120, 122 of the set 114 of edge scissor assemblies 106 and the second and third hubs 126, 128 of the center pole 102. FIG. 1 shows four center scissor assemblies 130, but other embodiments may include greater or fewer than four center scissor assemblies 130. In addition, in FIG. 1 the center scissor assemblies 130 are coupled to a corresponding set 114 of edge scissor assemblies 106 at approximately a midpoint of the set 114. However, in other embodiments, they may be coupled to a set 114 at a location other than the midpoint. In some embodiments, the plurality of center scissor assemblies 130 may be positioned along a single horizontal plane. In other embodiments, the center scissor assemblies 130 may be positioned at an upwards angle from a horizontal plane.

In addition to the center scissor assemblies 130, in some embodiments the canopy frame 100 further includes a plurality of center pole ribs 70. As shown in FIG. 1, each center pole rib 70 couples the center pole 102 to a respective side pole 104 and is oriented to point towards the center of the frame where the first hub 124 is located. In some embodiments, one end of the center pole rib 70 is pivotably coupled to a pole coupling member 44 (shown in FIGS. 4 and 5) located on a top surface of the first bracket 40, while the other end of center pole rib 70 is pivotably coupled to the first hub 124. In some embodiments, the center pole ribs 70 are collapsible at joints 70A.

In some embodiments, a plurality of support members 72 is provided to support and reinforce the center pole ribs 70 when the canopy frame is an expanded state as shown in FIG. 1. Support members 72 are coupled between center pole ribs 70 and respective side poles 104. One end of the support member 72 is pivotably coupled to move with second bracket 60 alongside pole 104 and the other end is pivotably coupled to center pole rib 70 at pole joint 74. According to some embodiments, each center pole rib 70 and support member 72 can fold and unfold along with the rest of the canopy frame 100.

Figure 2:
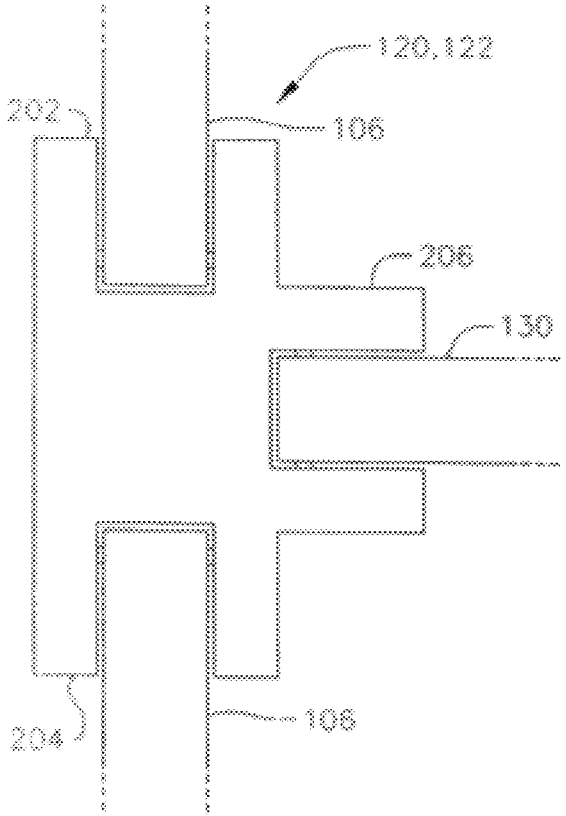
FIG. 2 Related Art
FIG. 2 is a top view of a connecting bracket of the canopy frame of FIG. 1.

Referring now to FIGS. 1 and 2, each of the upper and lower coupling brackets 120 and 122 has three coupling members 202, 204, and 206. The coupling members 202, 204, and 206 may be of the same or different shapes. The coupling members 202 and 204 face at substantially 180 degrees of each other, and are used to pivotably couple the edge scissor assemblies 106 of the same set 114 to each other. Specifically, upper coupling bracket 120 intercouples the upper inner ends 116 of edge scissor assemblies 106 in the same set 114. Lower coupling bracket 122 intercouples the lower inner ends 118 of edge scissor assemblies 106 in the same set 114. The coupling member 206 of each bracket faces at substantially a right angle with respect to each of the two 180-degree apart coupling members 202 and 204, and is used to pivotably couple the outer ends 137, 139 of center scissor assemblies 130 to a respective set 114 of edge scissor assemblies 106.

Figure 3:
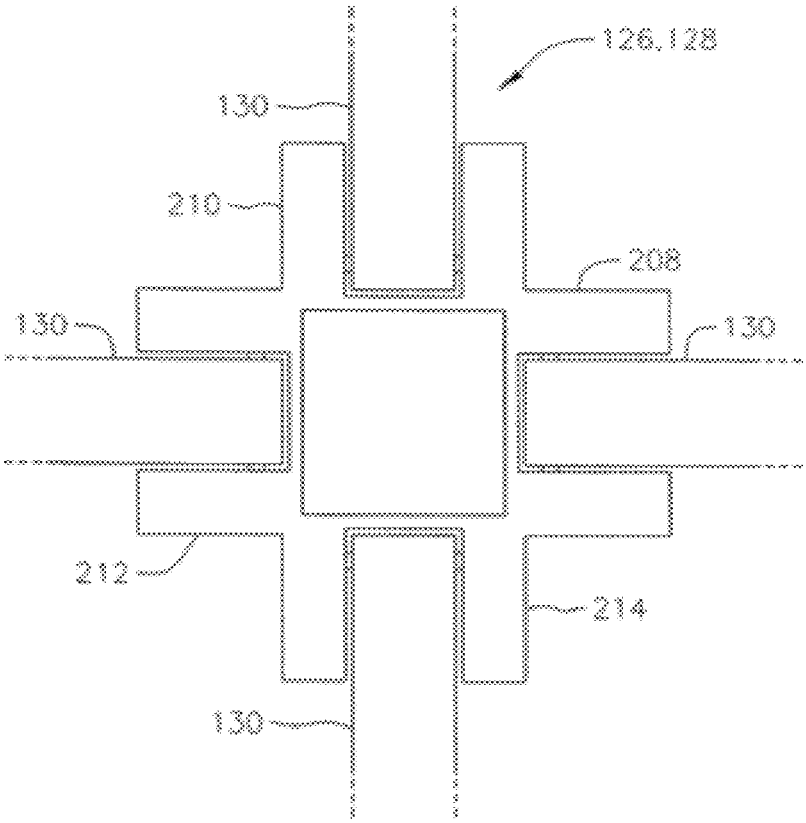
FIG. 3 Related Art
FIG. 3 is a top view of a hub of the canopy frame of FIG. 1.

Referring now to FIGS. 1 and 3, each of the second and third hubs 126 and 128 of center pole 102 has four coupling members 208, 210, 212, and 214, each facing one set 114 of edge scissor assemblies 106. The coupling members 208, 210, 212, and 214 may be of the same or different shapes. The second and third hubs 126 and 128 are pivotably coupled to four different center scissor assemblies 130 that extend from the second and third hubs 126 and 128 at approximately 90 degrees apart from one other. Hence, each center scissor assembly 130 is pivotably coupled between the center pole 102 and a corresponding set 114 of edge scissor assemblies 106. Alternatively, the second and third hubs 126 and 128 may include greater or fewer than four connecting members to pivotably couple any number of center scissor assemblies 130 at any desired angle apart from one another.

Figure 4:
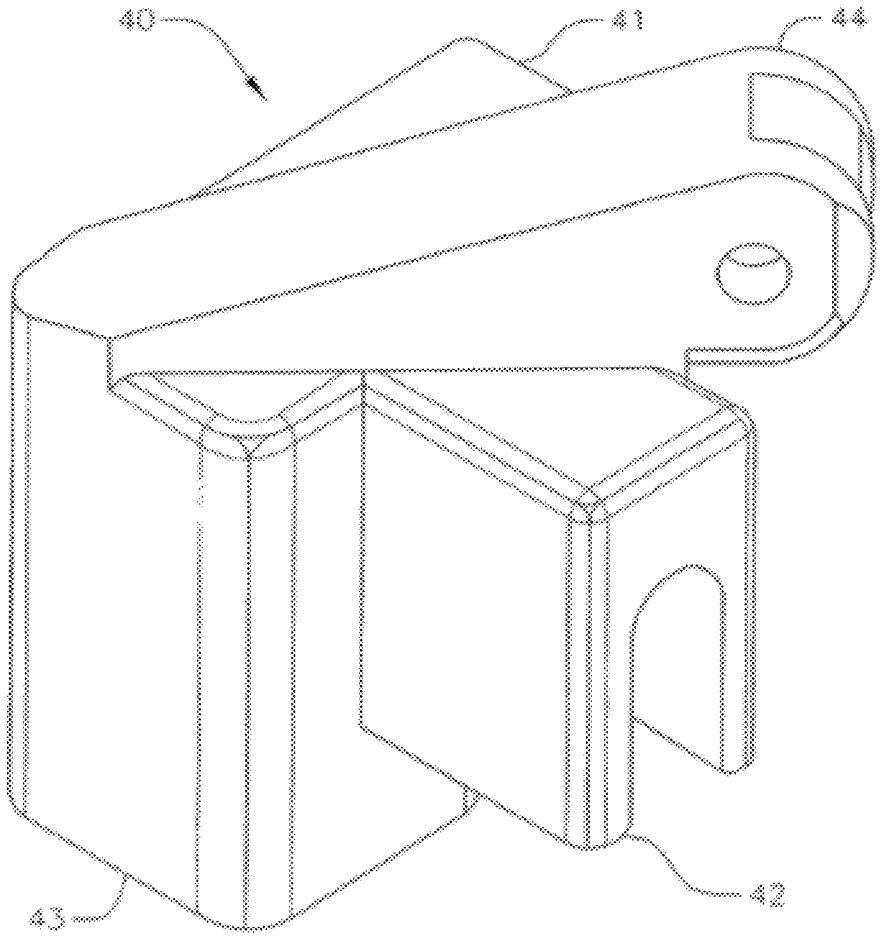
FIG. 4 Related Art
FIG. 4 is a perspective view of a first bracket of the canopy frame of FIG. 1.
Figure 5:
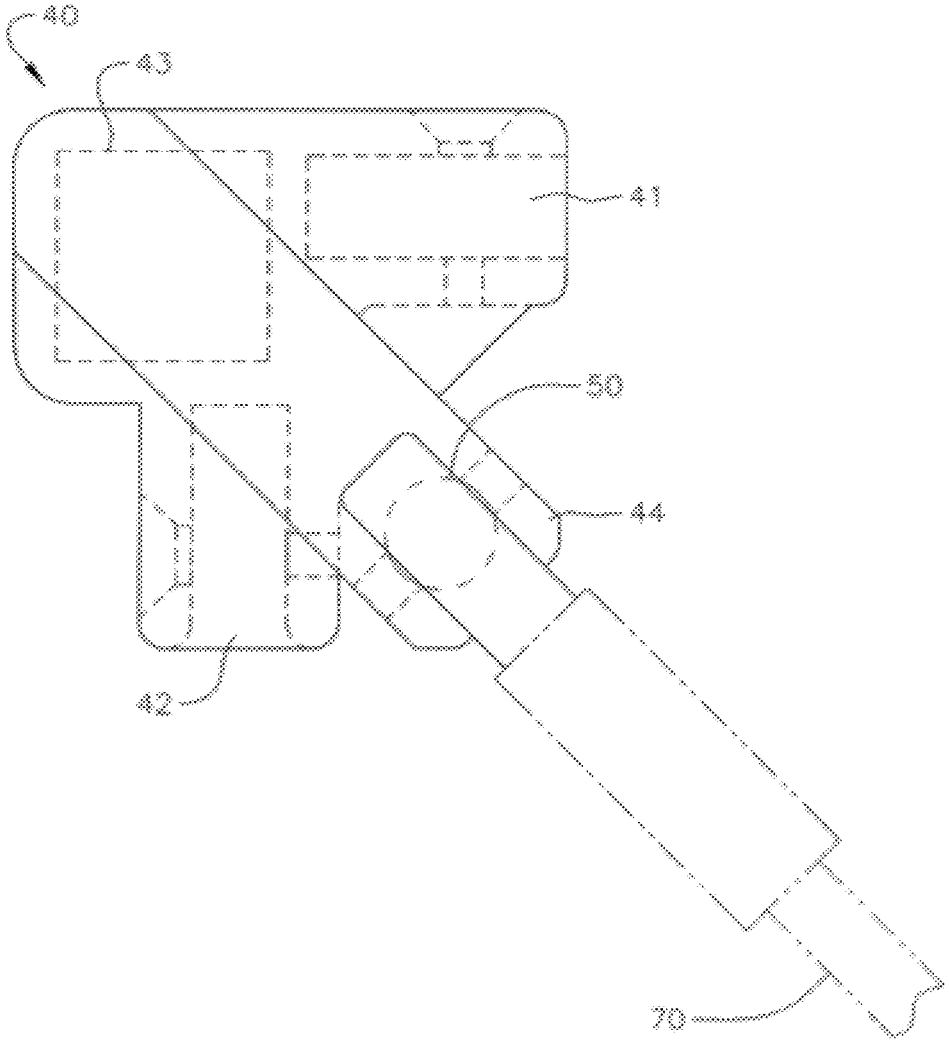
FIG. 5 Related Art
FIG. 5 is a top view of the first bracket of FIG. 4.

FIGS. 4 and 5 show the structure of each first bracket 40 according to one embodiment, which has a cavity 43 for receiving a side pole 104, supporting member portions 41 and 42 for receiving and pivotably coupling to upper outer ends 117 of edge scissor assemblies 106 at a corner of the canopy frame 100, and a pole coupling member 44 disposed on a top surface of the first bracket 40 and configured to pivotably couple to one of the center pole ribs 70. In some embodiments a spherical movable member 50 may be disposed on the end of center pole rib 70 to pivotably couple it to the pole coupling member 44. In other embodiments, the components described above may be pivotable relative to one another via pins or any other suitable devices or combination thereof.

Figure 6:
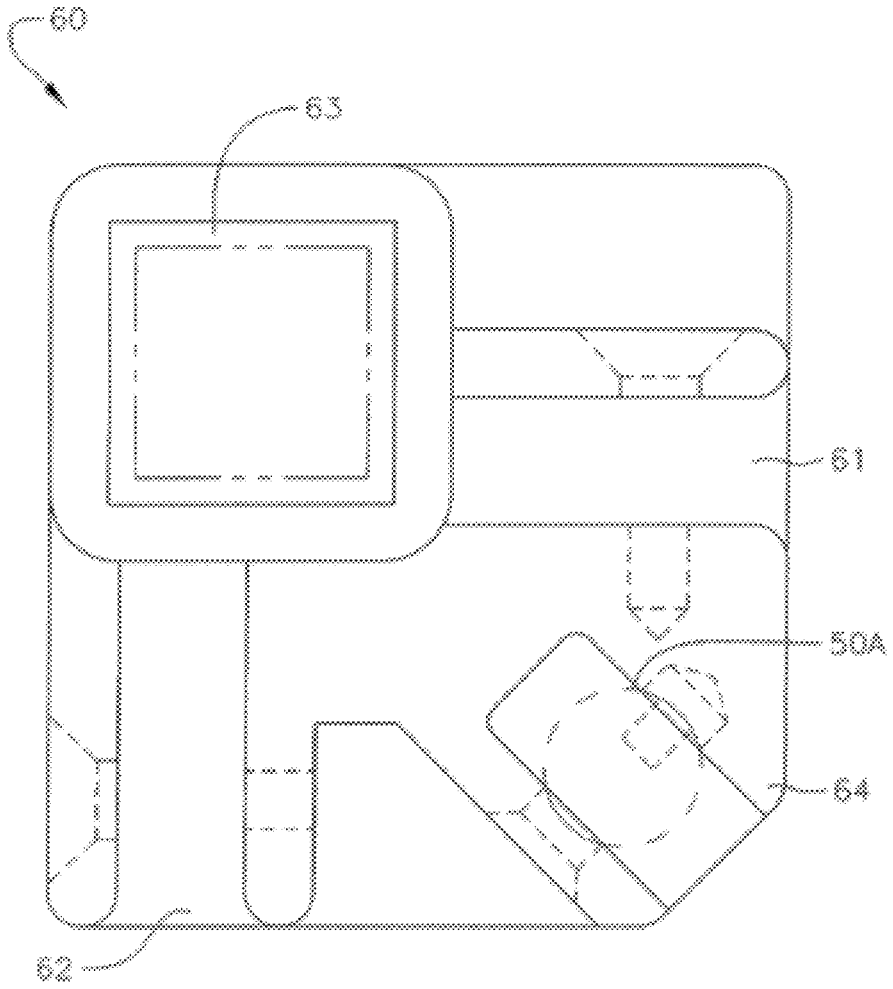
FIG. 6 Related Art
FIG. 6 is a top view of a second bracket of the canopy frame of FIG. 1.

FIG. 6 shows the structure of each second bracket 60 according to one embodiment, which has a cavity 63 through which a side pole 104 passes, supporting member portions 61 and 62 for receiving and pivotably coupling to lower outer ends 119 of edge scissor assemblies 106 at a corner of the canopy frame 100, and a support coupling member 64 configured to pivotably couple to one of the support members 72. In some embodiments, a spherical movable member 50A may be disposed on the end of support member 72 to pivotably couple it to the support coupling member 64. In other embodiments, the components described above may be pivotable relative to one another via pins or any other suitable devices or combination thereof.

Figure 7:
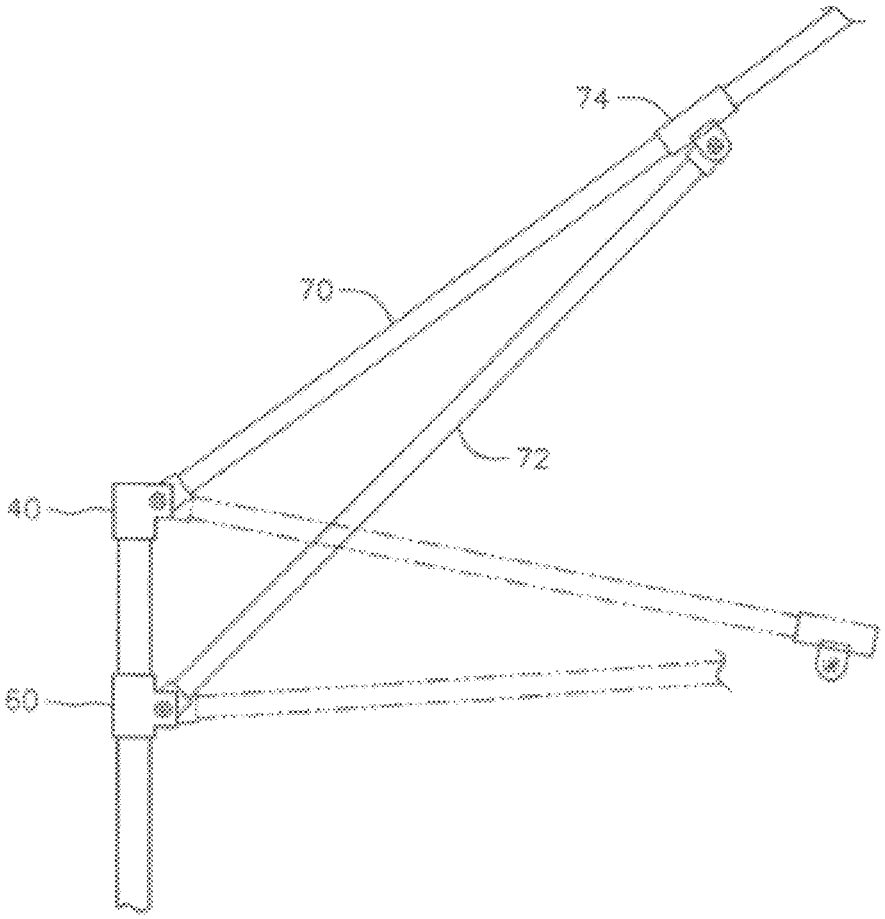
FIG. 7 Related Art
FIG. 7 is a frontal view of a support member of the canopy frame of FIG. 1.

FIG. 7 shows a frontal view of a support member 72 coupled between a side pole 104 and a corresponding center pole rib 70 according to an embodiment of the present invention. One end of support member 72 is pivotably coupled to move with the second bracket 60, and the other end of support member 72 is pivotably coupled to center pole rib 70 by a pole joint 74. In some embodiments, each support member 72 can fold and unfold along with the canopy frame 100. In some embodiments, support member 72 consists of a single rib member that may be curved or linear in shape when fully expanded. In some embodiments, center pole rib 70 consists of a single rib member that may be curved or linear in shape when fully expanded. Alternatively, center pole rib 70 may comprise a scissor assembly. Also, a canopy frame according to other embodiments of the present invention may include the center pole ribs 70 without the support members 72.

Figure 8:
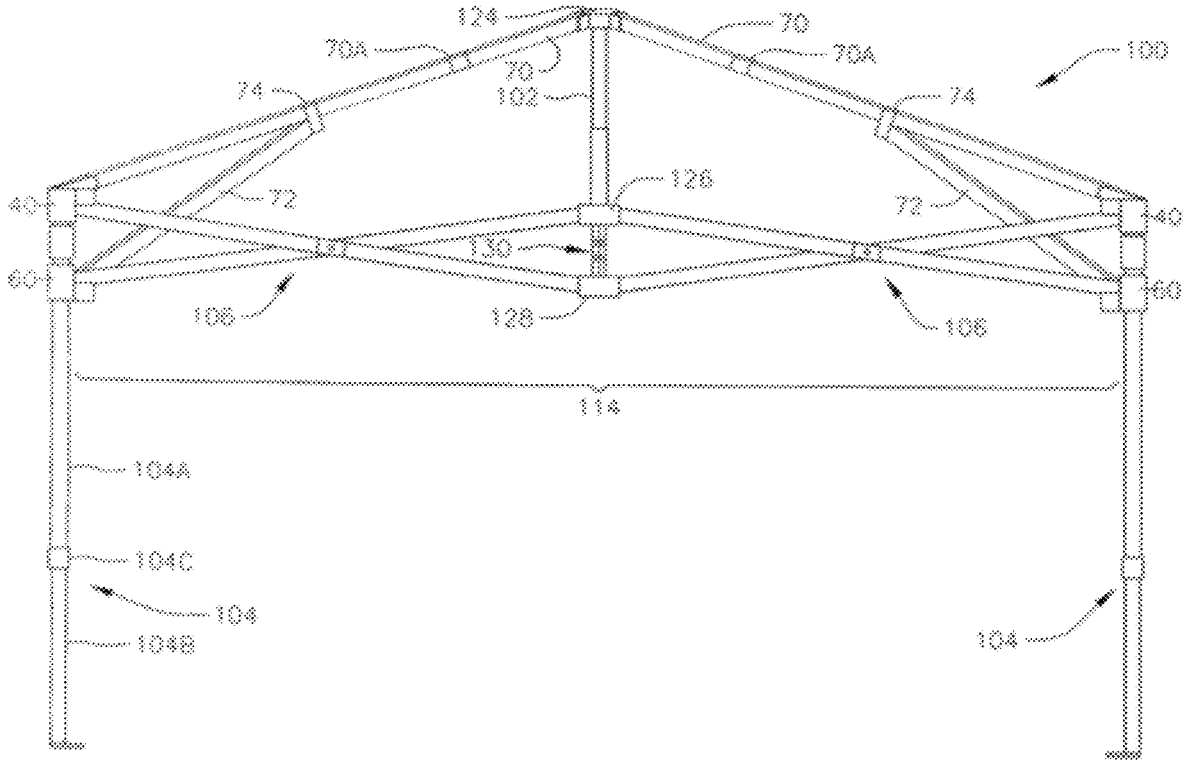
FIG. 8 Related Art
FIG. 8 is a side view of the canopy frame of FIG. 1.

FIG. 8 shows a side view of the canopy frame 100 of FIG. 1, including side poles 104, a set 114 of edge scissor assemblies 106 coupled to the center pole 102 at second and third hubs 126 and 128, and center pole ribs 70 collapsible at joints 70A and coupled to corresponding side poles 104 at a first bracket 40. The support members 72 are coupled at one end to the side pole 104 at a second bracket 60 and to the center pole rib 70 at joint hinge 74. The center pole ribs 70 are each coupled to the center pole 102 at first hub 124.

FIGS. 1 and 8 illustrate the collapsible canopy frame 100 in a fully opened position. In some embodiments, to expand the canopy frame 100 from a collapsed state to the fully opened state shown in FIGS. 1 and 8, the side poles 104 are pulled outwardly at the same time, stretching the canopy frame 100. As the side poles 104 are pushed outwardly, the second brackets 60 move upward along the side poles 104 while scissor members 108 and 132 rotate relative to one another to reduce the distance between their respective ends, elongating the edge and center scissor assemblies 106 and 130. As the second brackets 60 move upwardly alongside poles 104, support members 72 coupled to move with second brackets 60 also move upwardly and push the center pole ribs 70 upward. As the center pole ribs 70 are pushed upwardly, the center pole 102 is moved into a vertical supporting position for tautly supporting a canopy covering.

To collapse the canopy frame 100, the side poles 104 are pushed towards the center of the frame, forcing second brackets 60 to move away from first brackets 40 as scissor members 108 and 132 are rotated relative to one another to increase the distance between their respective ends. Meanwhile, each of the second brackets 60 moves downward along the upper section 104A of the side pole 104 towards the height adjustment bracket 104C and away from the first bracket 40. As the second bracket 60 moves downwardly, the joint hinge 74 moves down the center pole rib 70 towards the first bracket 40, such that the support members 72 coupled to side poles 104 at second brackets 60 pull the center pole ribs 70 downwardly. The center pole ribs 70 further fold at joints 70A, simultaneously moving the center pole 102 downwardly. The canopy frame 100 can thus be completely collapsed. Such a collapsed configuration effectively reduces the volume and weight of the canopy frame 100 and allows a user to easily and conveniently carry the canopy frame 100.

Figure 9:
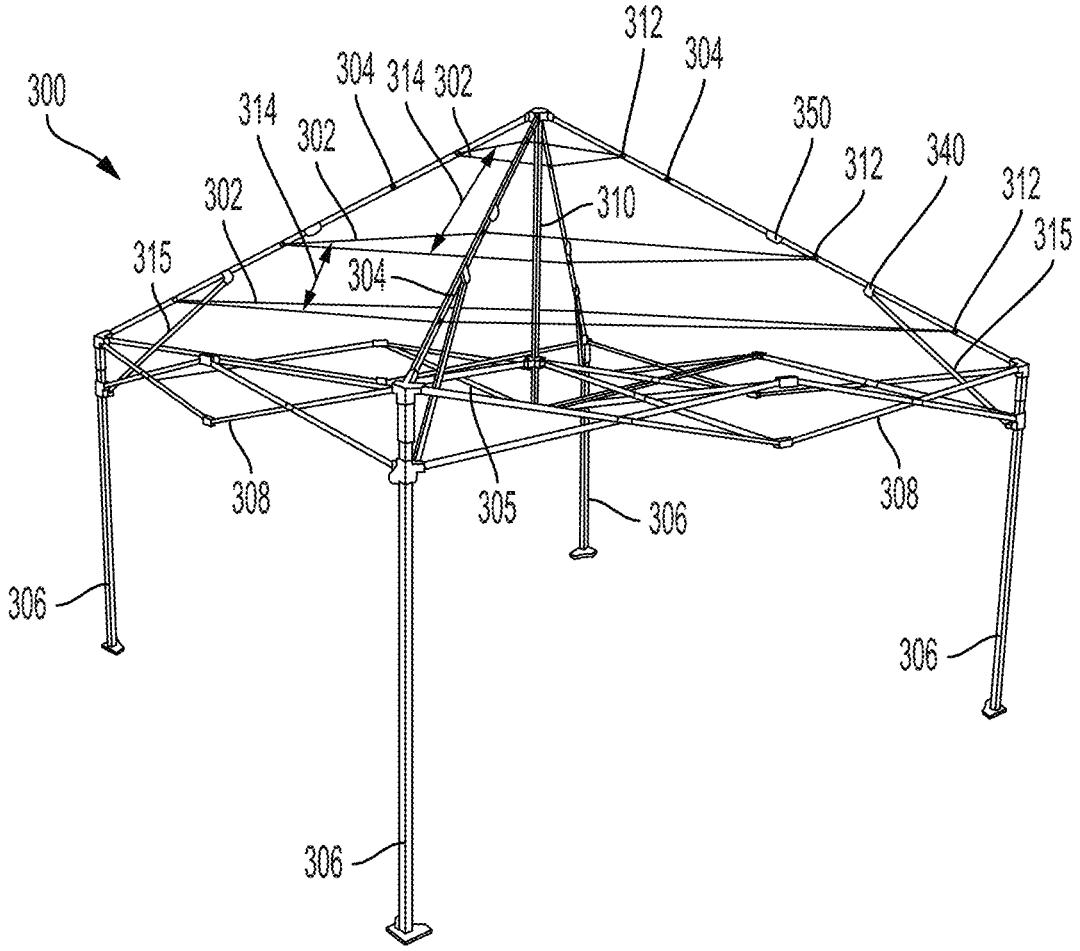
FIG. 9 is a perspective view of a canopy frame according to an embodiment of the present invention.
Figure 10:
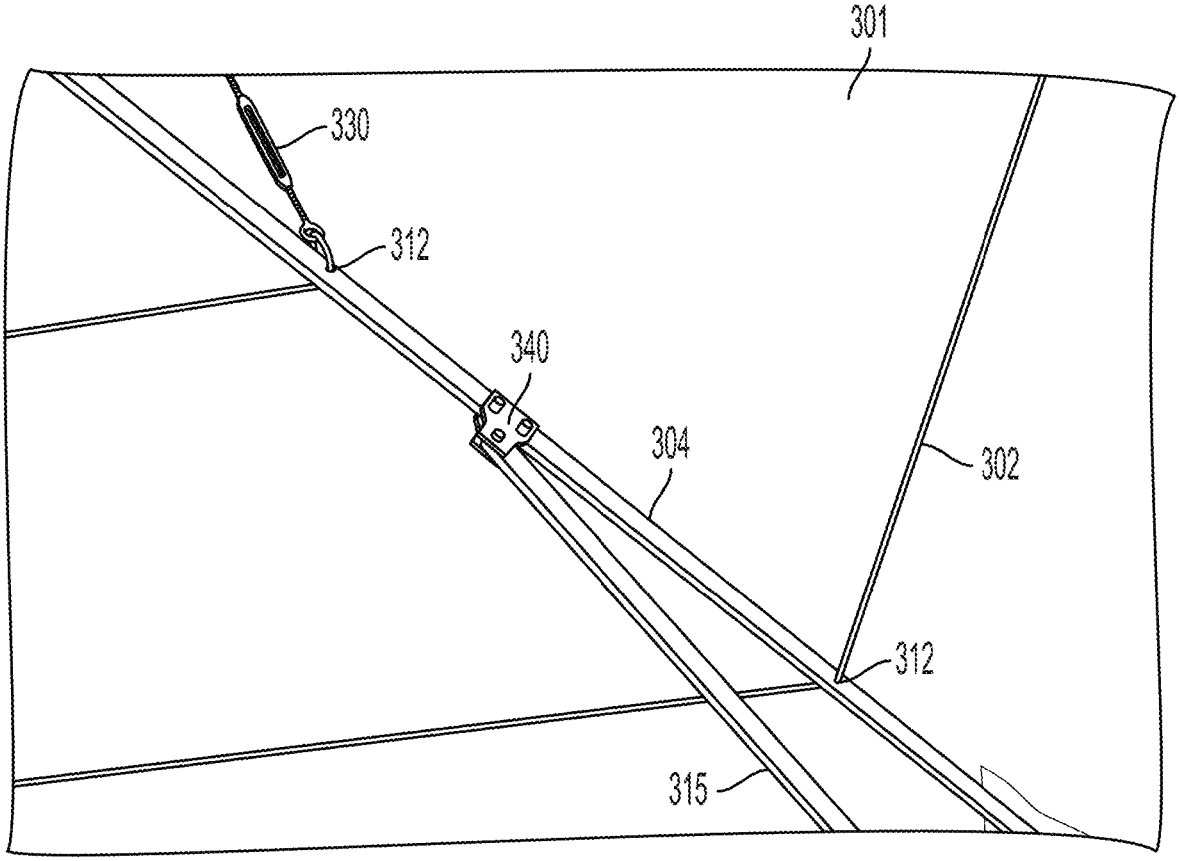
FIG. 10 is a perspective view of a portion of the canopy frame of FIG. 9.

Referring now to FIG. 9, a collapsible canopy frame 300 according to an embodiment of the present invention includes a plurality of center pole ribs 304, side poles 306, edge scissor assemblies 308, and a center pole 310. In some embodiments, the plurality of center pole ribs 304, side poles 306, edge scissor assemblies 308, and the center pole 310 have a same or similar configuration as those described above with respect to FIGS. 1-8. Further, in some embodiments, the collapsible canopy frame 300 may further include a plurality of center scissor assemblies 305 coupling the center pole 310 to the edge scissor assemblies 308, similar to those described above with respect to FIGS. 1-8. Further, the collapsible canopy frame 300 may include support members 315 coupled between the side poles 306 and the center pole ribs, similar to the support members 72 described above. For example, as shown in FIG. 10, each of the support members 315 may be hingedly coupled to a respective one of the center pole ribs at a joint 340 that is slidable along the center pole rib 304. The collapsible canopy frame 300 may be completely collapsed to effectively reduce the volume and weight of the canopy frame or be expanded to support a canopy covering 301. In some embodiments, the plurality of center pole ribs 304, side poles 306, edge scissor assemblies 308, and center pole 310 form a foundation. In embodiments, the collapsible canopy frame 300 includes one or more tension members 302 to provide support for the canopy covering 301. The one or more tension members 302 may be coupled to the plurality of center pole ribs 304 and may extend beneath a canopy covering 301 such that the canopy covering 301 may rest on the one or more tension members 302 when the collapsible canopy frame 300 is fully expanded. As shown in FIG. 10, in one or more embodiments, the joint 340 may be located between (e.g., between in the lengthwise direction of the center pole rib 304) a pair of the one or more tension members 302 when the collapsible canopy frame 300 is fully expanded. Accordingly, the one or more tension members 302 may prop up the canopy covering 301 and may counteract or resist a weight or downward pressure on the canopy covering 301 that may be caused by, for example, accumulated snow, rain, or wind.

The one or more tension members 302 may be coupled to the plurality of center pole ribs 304 according to various suitable structures. In an embodiment, each of the plurality of center pole ribs 304 has one or more through holes 312 to receive the one or more tension members 302 therethrough. For example, in some embodiments, the plurality of center pole ribs 304 may have a series of through holes 312 spaced apart from each other along a length of each of the plurality of center pole ribs 304 to receive one or more tension members 302, and each of the one or more tension members 302 may extend through a through hole 312 of each of the plurality of center pole ribs 304. In some embodiments, for example, the plurality of center pole ribs 304 may have a protrusion or a recess configured to catch or fix one or more tension members 302 to the plurality of center pole ribs 304. In some embodiments, the one or more tension members 302 may be attached to the plurality of center pole ribs 304 by bolts, clamps, hooks, loops, eyelets, lanyards, knots, lashings (i.e., wrapping the one or more tension members 302 around the plurality of center pole ribs 304), adhesive, or other fastening mechanisms. In some embodiments, the one or more tension members 302 may be detachably coupled to the plurality of center pole ribs 304 such that the one or more tension members 302 may be replaced or removed as desired.

As shown in FIG. 9, in an embodiment, each of the one or more tension members 302 may be a single continuous band extending through a through hole 312 of each of the plurality of center pole ribs 304. In some embodiments, each of the one or more tension members 302 may be segmented (i.e., not continuous), for example, where each tension member 302 has a first end coupled to one of the plurality of center pole ribs 304 and a second end coupled to a different one of the plurality of center pole ribs 304 (e.g., an adjacent one of the plurality of center pole ribs 304). In other words, the one or more tension members 302 may have a first end at one of the plurality of center pole ribs 304 and a second end at a second one of the plurality of center pole ribs 304. In other embodiments, one or more of the tension members 302 may be a single continuous band extending through one or more through holes 312 corresponding to one or more of the plurality of center pole ribs 304 and other one or more tension members may be segmented where the other one or more tension members 302 each has, for example, a first end coupled to one of the plurality of center pole ribs 304 and a second end coupled to a different one of the plurality of center pole ribs 304. Accordingly, in some embodiments, the one or more tension members 302 may be more easily replaced without affecting other segments of the one or more tension members 302 while the collapsible canopy frame 300 is in an expanded or a collapsed state. In some embodiments, the one or more tension members have a first end coupled to one of the plurality of center pole ribs 304 and a second end configured to be coupled to or fastened to a corresponding end of another one of the one or more tension members 302. Therefore, two of the one or more tension members 302 may have a first end coupled to different ones of the plurality of center pole ribs 304 and a second end coupled to each other.

Figure 11:
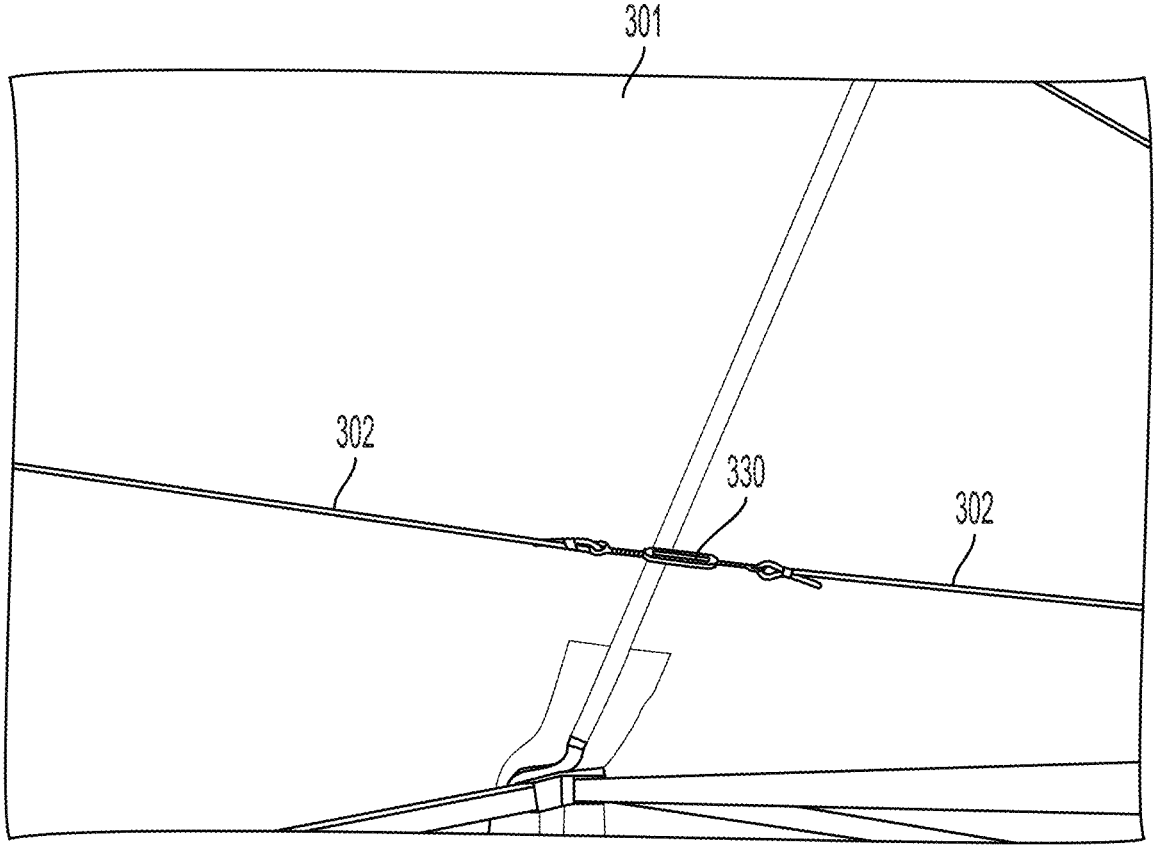
FIG. 11 is a perspective view of a tensioner of the canopy frame of FIG. 9, according to an embodiment.

The second ends of the one or more tension members 302 may be coupled by any of various suitable tying or fastening mechanisms, such as a male-female mold, a tied knot, or a tensioner mechanism. As shown in FIG. 11, for example, ends of two segments of a tension member 302, or opposite ends of a continuous tension member 302 may be coupled via a tensioner (tension adjuster) 330 configured to be adjusted to increase or decrease an amount of tension. For example, the one or more tension members 302 may stretch or expand (e.g., with temperature or over time), and the tensioner 330 may be utilized to increase an amount of tension in the tension members 302. Further, one or more of the tensioners 330 may be provided along each of the one or more tension members 302. Although, the one or more tension members 302 are described as having two ends, the one or more tension members 302 may have any number of ends to attach to different points of the plurality of center pole ribs 304.

In some embodiments, the one or more tension members 302 may be rigid (e.g., bars, panels, rods, etc.) In an embodiment, the one or more tension members 302 may be detachably coupled to the plurality of center pole ribs 304. For example, the one or more tension members 302 may be attached after or while the collapsible canopy frame 300 is expanded. In some embodiments, the one or more tension members 302 may be capable of collapsing (e.g., folding) with and expanding (e.g., unfolding) with the collapsible canopy frame 300. For example, the one or more tension members 302 may be telescoping or foldable.

In some embodiments, the one or more tension members 302 may be flexible or elastic. In an embodiment, the one or more tension members 302 may be loose or slack when the collapsible canopy frame 300 is collapsed. When the collapsible canopy frame 300 is expanded, the one or more tension members 302 may be tense or firm so as to resist a force or pressure exerted on the one or more tension members 302. In other words, the one or more tension members 302 may be elastic such that the one or more tension members 302 may contract or bend when the collapsible canopy frame 300 collapses, and the one or more tension members 302 may be stretched or taut to resist weight on the canopy covering 301 when the collapsible canopy frame 300 is fully expanded. Therefore, the one or more tension members 302 assist in reducing deformation of the canopy covering 301.

Figure 12:
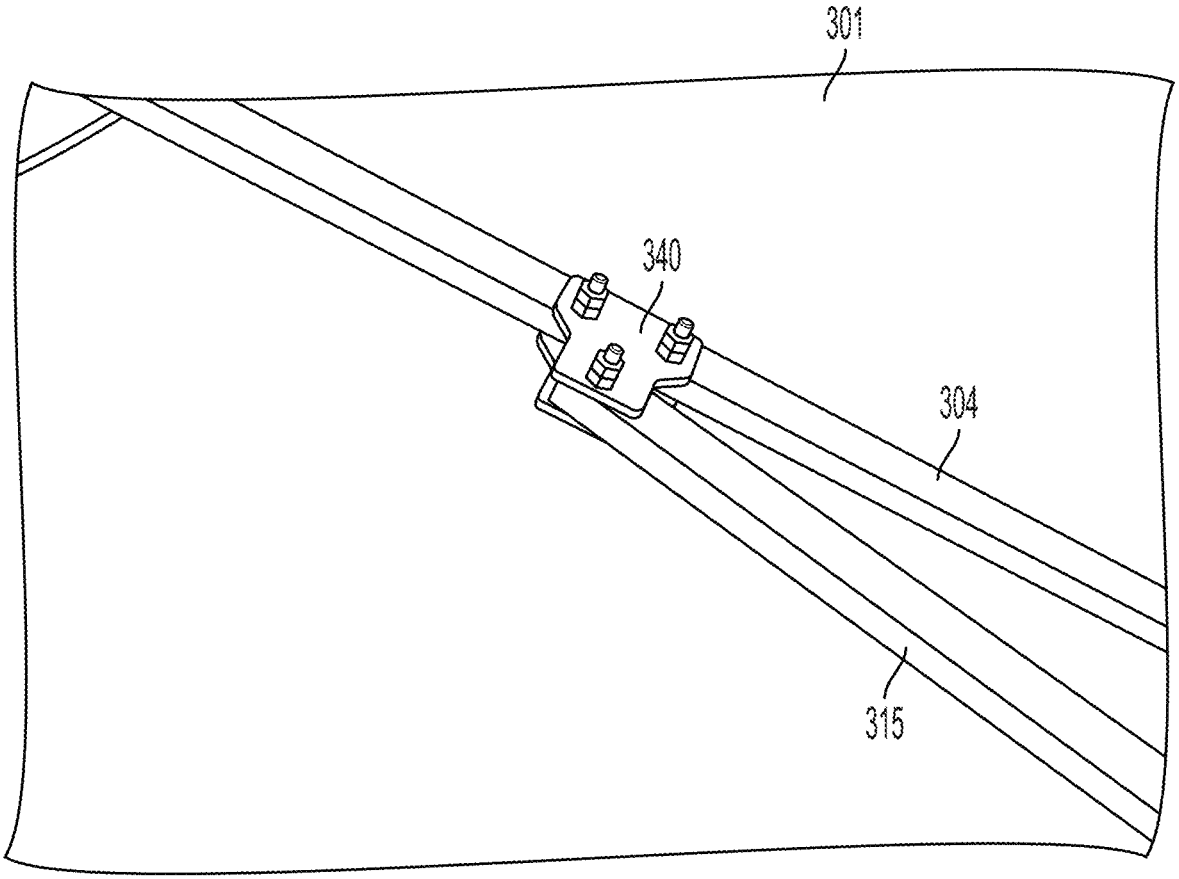
FIG. 12 is a perspective view of a joint of the canopy frame of FIG. 9, according to an embodiment.

In some embodiments, the one or more tension members 302 are cables (or wires); however, in some embodiments, the one or more tension members may be any structural element that can withstand axial or bending forces, such as a rod, bar, panel, rope, braided rope, or strap, for example. Further, the cable or other structural element may have a suitable size or gage or may be made of a suitable material (e.g., steel or aluminum), which may be varied depending on the number of the one or more tension members 302 or an anticipated amount of force to be resisted, for example. In an embodiment, for example, the one or more tension members 302 may be stainless steel cables having a diameter of 3 mm. Similarly, the center pole ribs 304 may be made of a suitable material (e.g., steel, aluminum, or plastic) and/or thickness depending on the application, such as to resist bending or collapsing under a large load. In an embodiment, the joint 340 (see FIG. 12) may be made of steel or another suitable material to withstand forces (e.g., snow loading) acting on the center pole ribs 304. For example, in one or more embodiments, the collapsible canopy frame 300 and a canopy covering 301 may be configured to withstand snow loading of 200 kg or accumulated snow of 20 cm in thickness.

Figure 13:
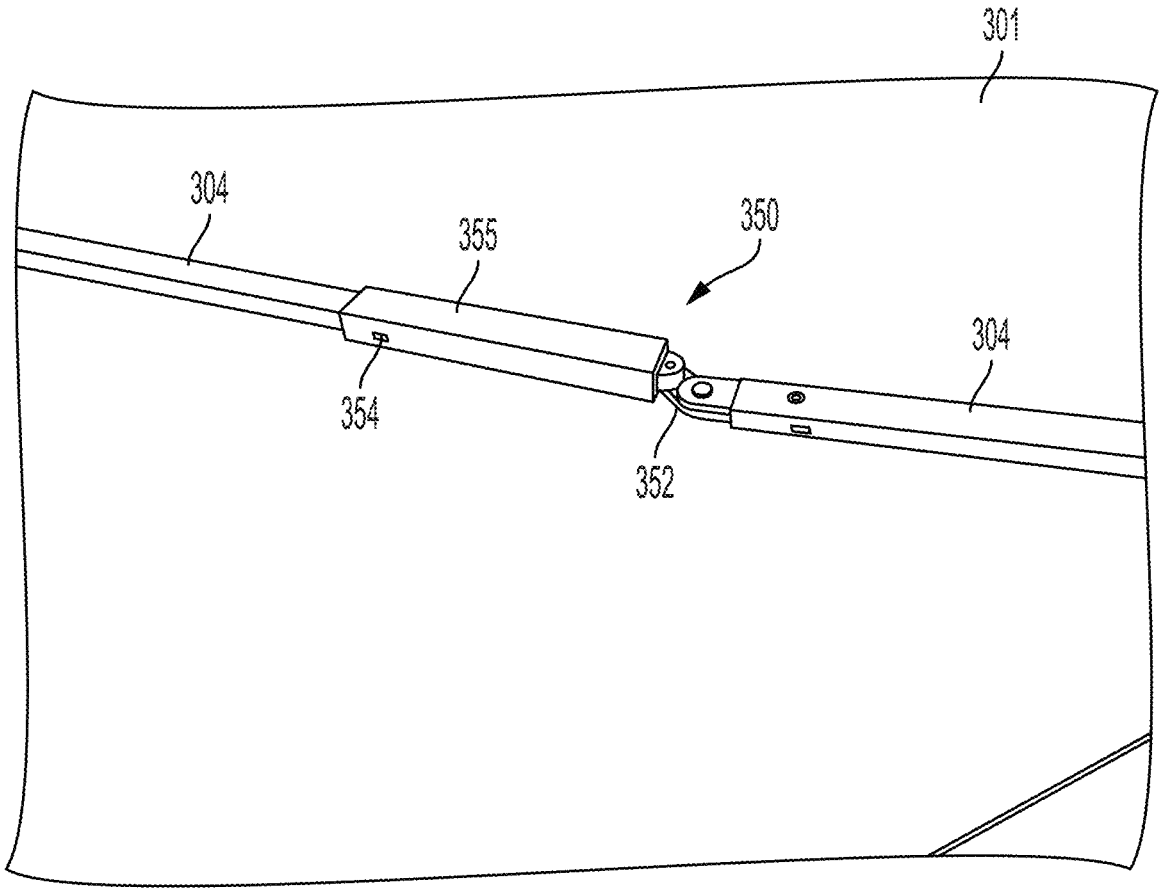
FIG. 13 is a perspective view of a hinge of the canopy frame of FIG. 9, according to an embodiment.

In embodiments, each of the center pole ribs 304 may be configured as two segments hinged to each other at a hinge 350 located between the joint 340 and an end of the center pole rib that is coupled to the center pole 310. In one or more embodiments, the hinge 350 may have a structure to withstand forces (e.g., snow loading) acting on the center pole ribs 304. As shown in FIG. 13, in an embodiment, the hinge 350 includes a pivotable hinge portion 352 and a sleeve portion 355 to cover the hinge portion 352 and provide additional strength when the collapsible canopy frame 300 is in the expanded state. The sleeve portion 355 may be slidable along a first direction of the center pole rib 304 such that the hinge portion 352 may be pivoted during collapsing of the collapsible canopy frame 300 and may be slidable along an opposite direction to cover the hinge portion 352. In an embodiment, the sleeve portion 355 may include a locking device, such as a protrusion (e.g., a spring-biased protrusion) receivable in an opening 354, such that the sleeve portion 355 may be captured in a position covering the hinge portion 352 when the collapsible canopy frame 300 is in the expanded state. The hinge 350 may be made of steel or another suitable material.

As shown in FIG. 9, in some embodiments, the one or more tension members 302 are substantially parallel and spaced apart from (e,g, spaced from) each other. Although only three tension members are shown in the illustrated embodiment, in some embodiments, there may be less than three or greater than three tension members. As shown in the illustrated embodiment, the one or more tension members 302 and the plurality of center pole ribs 304 define a plurality of gaps 314 between the one or more tension members 302. In some embodiments, each of the gaps 314 may decrease in width from the uppermost gap of the plurality of gaps 314 to the lowermost gap of the plurality of gaps 314. In other words, in some embodiments, the distance between adjacent ones of the one or more tension members 302 decreases from an upper portion of the plurality of center pole ribs 304 to a lower portion of the plurality of center pole ribs 304. Therefore, the one or more tension members 302 may provide greater resistance to deformation of the canopy covering 301 toward a lower end of the canopy which may catch runoff or debris or may accumulate a large volume of snow, for example. In one embodiment, for example, the collapsible canopy frame 300 may include the two lower ones but not the upper one of the one or more tension members 302 shown in FIG. 9. In this case, for example, the lowermost tension member of the two lower ones is closer to the other tension member of the two lower ones than the other tension member is to the center pole (e.g., the upper end or apex of the center pole 310).

In some embodiments, the one or more tension members 302 have a length dependent on the distance between adjacent ones of the plurality of center pole ribs 304. For example, in the illustrated embodiment, the one or more tension members 302 increase in length from the uppermost tension member 302 to the lowermost tension member 302 such that the one or more tension members 302 are taut or stretched when the collapsible canopy frame 300 is fully expanded. Therefore, in some embodiments, the one or more tension members 302 may have a preset length and tension based on the collapsible canopy frame 300 when it is fully expanded. In some embodiments, the one or more tension members 302 may have an adjustable length and/or adjustable tension.

In some embodiments, the one or more tension members 302 may cross each other at a point between two adjacent ones of the plurality of center pole ribs 304. Accordingly, the one or more tension members 302 may provide additional support for the canopy cover and reduce the potential for formation of pockets in the canopy cover.

Figure 14:
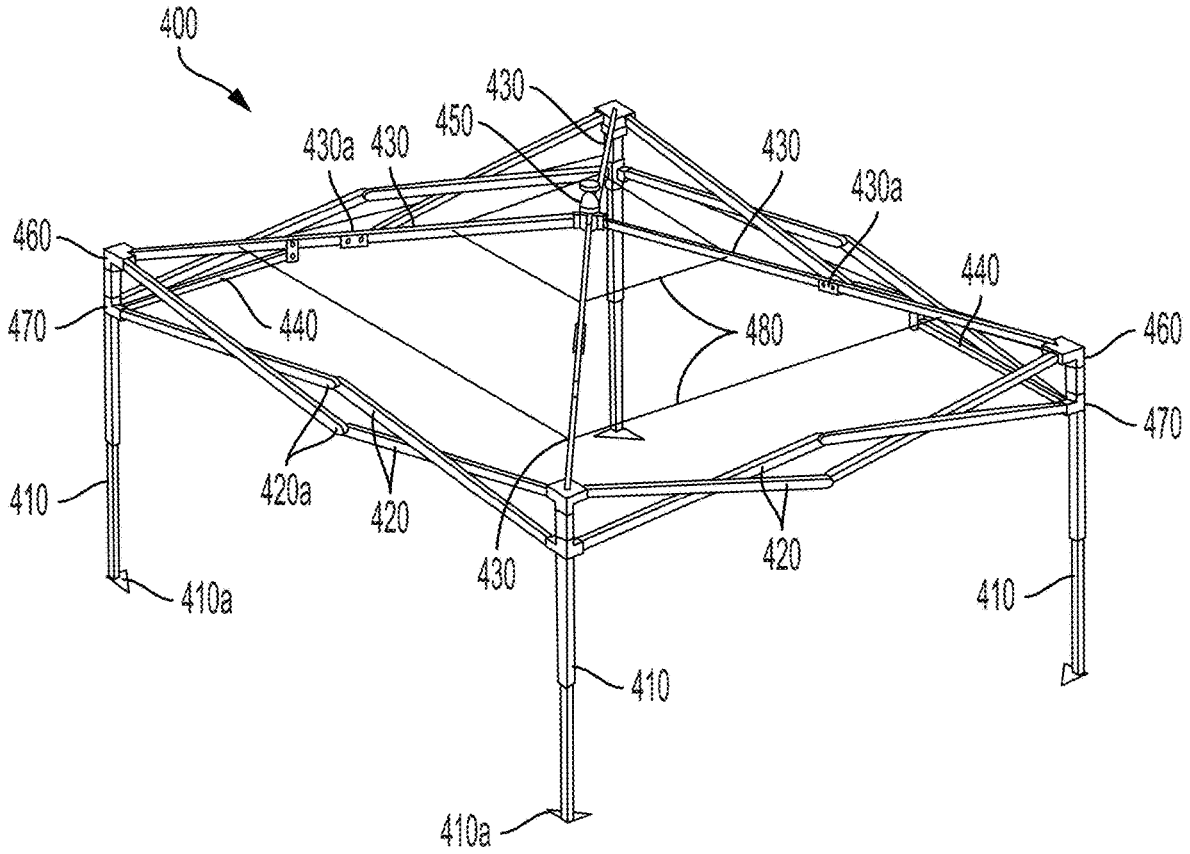
FIG. 14 is a perspective view of a canopy frame according to another embodiment of the present invention.

Referring now to FIG. 14, a collapsible canopy frame 400 according to another embodiment may comprise a plurality of side pole connection beams or ribs 420, with each pair of ribs 420 being coupled to each other to define a scissor assembly. The scissor assemblies of the side pole ribs 420 are also coupled to each other at joints 420*a* and are connected to four side poles 410 at their outside ends. In such a case, the outside upper end of each scissor assembly of the ribs 420 is hinged to a connector 460 provided at the top end of each side pole 410, while the outside lower end of each scissor assembly is hinged to a slider 470 movably fitted over the side pole 410. Each of the four side poles 410 is individually coupled to a center pole 450, which may have a simple construction, through a respective center pole rib 430, and each of the four side poles 410 is provided with a claw 410*a* at the lower end, thus being stably held on the ground. In an embodiment, the center pole ribs 430 each comprise two rib members, which have a same construction and are coupled to each other through a hinge joint 430*a*. The above-mentioned center pole ribs 430 are also coupled to the sliders 470 through support links 440 at the outside rib members, respectively. Therefore, the collapsible canopy frame 400 may be easily and quickly stretchable or collapsible, as described in U.S. Pat. No. 5,944,040, which is incorporated herein by reference in its entirety.

The collapsible canopy frame 400 also includes one or more tension members 480 coupled to the center pole ribs 430. The one or more tension members 480 may have a same or similar construction and may be coupled to the center pole ribs 430 in a same or similar manner as described above with reference to FIGS. 9-13.

Figure 15:
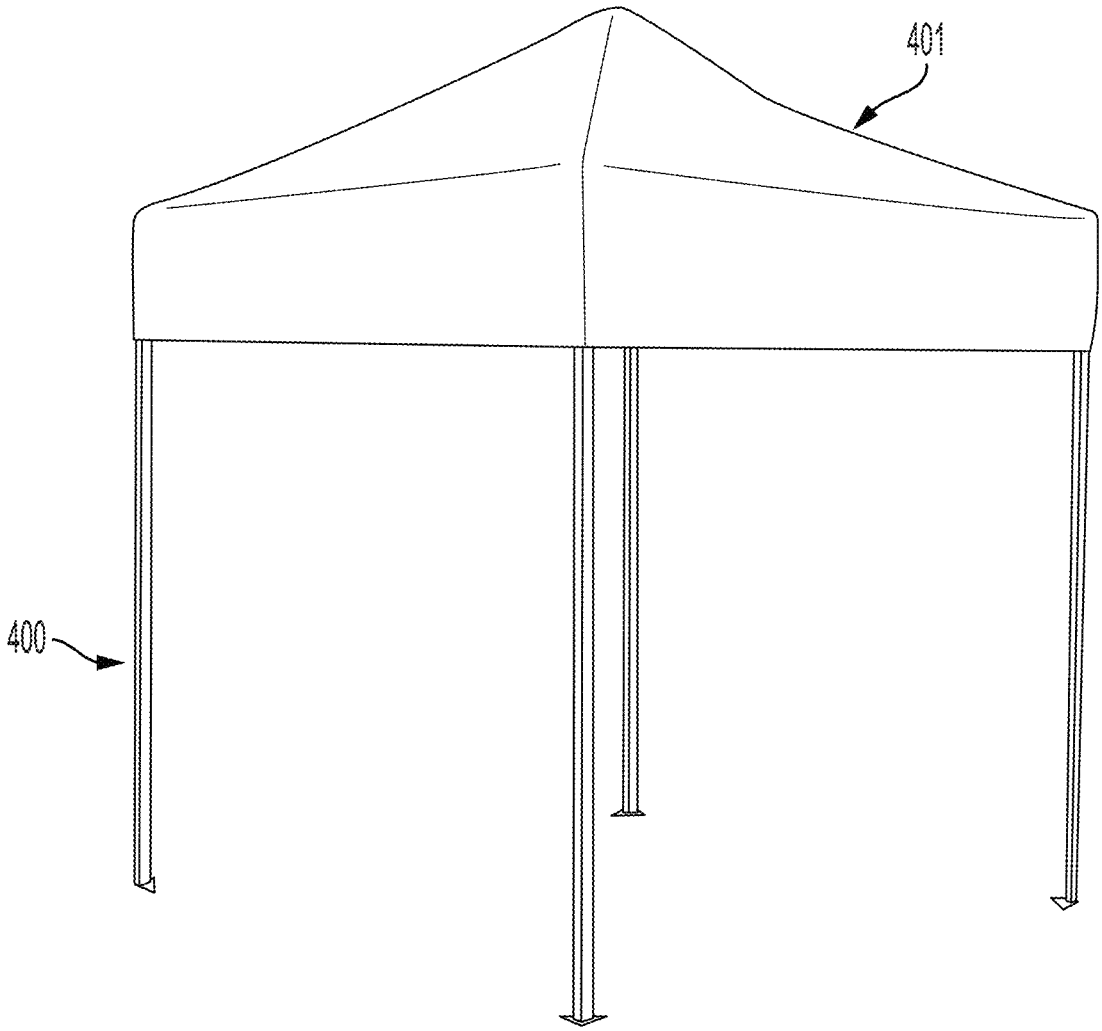
FIG. 15 is a perspective view of the canopy frame of FIG. 14 supporting a canopy covering according to another embodiment of the present invention.

As shown in FIG. 15, the collapsible canopy frame 400 may support a canopy covering 401 having the same or similar construction to the canopy covering 301 described with reference to FIGS. 9-13. The one or more tension members 480 may prop up the canopy covering 401 and may counteract or resist a weight or downward pressure on the canopy covering 401 that may be caused by, for example, accumulated snow, rain, or wind.

Although the drawings and accompanying description illustrate some embodiments of a collapsible canopy frame according to embodiments of the present invention, it will be apparent that the collapsible canopy frame according to embodiments of the present invention may also be carried out by utilizing alternative structures, sizes, shapes, and/or materials in other embodiments. For example, the side poles, center pole ribs, and scissor assemblies described above could be coupled together by any suitable coupling means, including by gluing, welding, screwing, and/or nailing.

While this invention has been described in detail with particular references to embodiments thereof, the embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention. Although relative terms such as "inner," "outer," "upper," "lower," and similar terms have been used herein to describe a spatial relationship of one element to another, it is understood that these terms are intended to encompass different orientations of the various elements and components of the invention in addition to the orientation depicted in the figures. Additionally, as used herein, the term "substantially" and similar terms are used as terms of approximation and not as terms of degree, and are intended to account for the inherent deviations in measured or calculated values that would be recognized by those of ordinary skill in the art. Furthermore, as used herein, when a component is referred to as being "on" or "coupled to" another component, it can be directly on or attached to the other component or intervening components may be present therebetween.

The terminology used herein is for the purpose of describing particular embodiments only and is not intended to be limiting of the inventive concept. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

What is claimed is:

1. A collapsible canopy frame comprising:

a plurality of side poles;

a plurality of edge scissor assemblies coupling adjacent side poles from among the plurality of side poles to each other;

a center pole to support a canopy covering;

a plurality of center pole ribs each coupling the center pole to a respective side pole of the adjacent side poles;

a plurality of support members coupling the plurality of center pole ribs to the adjacent side poles, the plurality of support members being coupled to the plurality of center pole ribs through respective joints that are movable along respective center pole ribs from among the plurality of center pole ribs; and a plurality of tension members coupled to the plurality of center pole ribs, wherein the plurality of tension members are substantially parallel and spaced from each other, and wherein the respective joints are between a pair of the plurality of tension members in accordance with the collapsible canopy frame being in an expanded state.

2. The collapsible canopy frame of claim 1, wherein each of the plurality of tension members is a single continuous band.

3. The collapsible canopy frame of claim 1, wherein each of the plurality of center pole ribs has a through hole to receive a tension member from among the plurality of tension members.

4. The collapsible canopy frame of claim 1, wherein the plurality of tension members are detachably coupled to the plurality of center pole ribs.

5. The collapsible canopy frame of claim 1, further comprising a tensioner coupled to opposite ends of a tension member from among the plurality of tension members, the tensioner being configured to adjust an amount of tension applied to the tension member.

6. The collapsible canopy frame of claim 1, further comprising a plurality of center scissor assemblies coupling the center pole to the plurality of edge scissor assemblies.

7. The collapsible canopy frame of claim 1, wherein tension members of the plurality of tension members are different in length from each other.

8. A collapsible canopy frame comprising:

a plurality of side poles;

a plurality of edge scissor assemblies coupling adjacent side poles from among the plurality of side poles to each other;

a center pole to support a canopy covering;

a plurality of center pole ribs each coupling the center pole to a respective side pole of the adjacent side poles;

a plurality of support members coupling the plurality of center pole ribs to the adjacent side poles, the plurality of support members being coupled to the plurality of center pole ribs through respective joints that are movable along respective center pole ribs from among the plurality of center pole ribs; and a plurality of tension members coupled to the plurality of center pole ribs, wherein the plurality of tension members are substantially parallel and spaced from each other, and wherein a distance between adjacent tension members from among the plurality of tension members decreases along a direction from an upper portion of the plurality of center pole ribs to a lower portion of the plurality of center pole ribs.

9. A collapsible canopy frame comprising:

a center pole to support a canopy covering;

a first center pole rib coupling the center pole to a first side pole;

a second center pole rib coupling the center pole to a second side pole;

a first edge scissor assembly coupling the first side pole to the second side pole;

a tension member coupled to the first center pole rib and the second center pole rib; and an other tension member closer to the center pole than the tension member is to the center pole, wherein the tension member is closer to the other tension member than the other tension member is to the center pole.

10. The collapsible canopy frame of claim 9, wherein the tension member is a single continuous band.

11. The collapsible canopy frame of claim 9, wherein the first center pole rib has a through hole to receive the tension member.

12. The collapsible canopy frame of claim 9, wherein the tension member is detachably coupled to the first center pole rib.

13. The collapsible canopy frame of claim 9, further comprising a tensioner coupled to opposite ends of the tension member, the tensioner being configured to adjust an amount of tension applied to the tension member.

14. The collapsible canopy frame of claim 9, further comprising a first center scissor assembly coupling the center pole to the first edge scissor assembly.

15. The collapsible canopy frame of claim 9, further comprising a support member coupling the first center pole rib to the first side pole, the support member being coupled to the first center pole rib through a joint that is movable along the first center pole rib, wherein the joint is between the tension member and the other tension member in accordance with the collapsible canopy frame being in an expanded state.

16. The collapsible canopy frame of claim 9, wherein the tension member and the other tension member are different in length from each other.

* * * * *